United States Patent [19]

Asada et al.

[11] 4,117,565

[45] Oct. 3, 1978

[54] CHROMIUM BASE ALLOY COMPOSITE MATERIALS REINFORCED WITH CONTINUOUS SILICON CARBIDE FIBERS AND A METHOD FOR PRODUCING THE SAME

[75] Inventors: Chiaki Asada, Nagoya; Katsushi Kusaka, Tokai; Hisashi Kajima, Asahi, all of Japan

[73] Assignee: The Foundation: The Research Institute For Special Inorganic Materials, Japan

[21] Appl. No.: 827,060

[22] Filed: Aug. 23, 1977

[30] Foreign Application Priority Data

Aug. 31, 1976 [JP] Japan ..... 51/103829

[51] Int. Cl.[2] ..... B22F 3/14

[52] U.S. Cl. ..... 75/204; 29/419 R; 75/DIG. 1; 75/229; 75/236; 75/246; 423/345; 428/608; 428/614

[58] Field of Search ..... 29/419 R; 75/DIG. 1, 75/204, 229, 236, 246; 423/345, 346; 428/605, 608, 614

[56] References Cited

U.S. PATENT DOCUMENTS

| | | | |
|---|---|---|---|
| 1,826,454 | 10/1931 | Comstock | 75/236 |
| 3,364,975 | 1/1968 | Gruber | 75/DIG. 1 |
| 3,459,842 | 8/1969 | Wakefield | 75/236 X |
| 3,691,623 | 9/1972 | Staudhammer et al. | 29/419 X |
| 3,836,673 | 7/1974 | Weaver et al. | 75/236 X |

FOREIGN PATENT DOCUMENTS

| | | | |
|---|---|---|---|
| 1,213,619 | 3/1966 | Fed. Rep. of Germany | 75/236 |
| 2,236,078 | 3/1974 | Fed. Rep. of Germany. | |
| 1,128,757 | 10/1968 | United Kingdom | 423/346 |
| 508,475 | 6/1976 | U.S.S.R. | 423/346 |

*Primary Examiner*—Richard E. Schafer

*Attorney, Agent, or Firm*—Ladas, Parry, Von Gehr, Goldsmith & Deschamps

[57] ABSTRACT

Chromium base alloy composite materials having high corrosion resistance, oxidation resistance and tensile strength at high temperatures are produced by laminating and arranging silicon carbide fibers containing 0.01–20% by weight of free carbon, which have been produced by the specific method already disclosed in U.S. patent application Ser. No. 677,960, in volume fraction of 2–50% in chromium base alloy and by compressing and sintering the assembly.

4 Claims, 5 Drawing Figures

Tensile Strength
Alloy Matric: 50Cr-50Fe
Volume Fraction of Sic Fibers: 13-15 %
Elongation
Tensile Strenght (Kg/mm2)
Elongation (%)
Free Carbon Content
100
80
60
12
8
4
0
0
5
10
15
20

Tensile Strength
Alloy Matrix: 60Cr-40Ni
Elongation
Tensile Strenght (Kg/mm2)
Elongation (%)
Volume Fraction of SiC Fibers (%)
200
150
100
50
12
8
4
0
10
20
30
40
50
60

CHROMIUM BASE ALLOY COMPOSITE MATERIALS REINFORCED WITH CONTINUOUS SILICON CARBIDE FIBERS AND A METHOD FOR PRODUCING THE SAME

BACKGROUND OF THE INVENTION

1. Field of the Invention

The present invention relates to materials having high mechanical strength and corrosion resistance at high temperatures and heat resistance, which are reinforced with silicon carbide fibers and particularly to chromium base alloy composite materials reinforced with silicon carbide fibers.

Gas turbine using heavy oil of lower quality as fuel is heavily damaged by hot corrosion owing to vanadium oxide and sulfurous acid gas contained in combustion gas and for the purpose, super heat resistant alloys containing a large content of chromium have been used. However, as the chromium content in these alloys increases, the tensile strength at high temperatures lowers, so that the desired properties are not always fully satisfied.

2. Description of the Prior Art

As mentioned above, super alloys having a large content of chromium, such as 50Cr—50Ni, 50Cr—50Fe, 60Cr—40Co have been used under the severe condition wherein the corrosion and the oxidation at high temperatures proceed. However, chromium is more weak in the tensile strength at high temperatures than nickel, cobalt, molybdenum and the like, so that when it is intended to increase the corrosion resistance and the oxidation resistance, the tensile strength at high temperatures inconveniently lowers. Accordingly, it has been difficult to obtain materials having high corrosion resistance, oxidation resistance and tensile strength at high temperatures.

On the contrary, in this invention, chromium base alloy composite materials reinforced with silicon carbide fibers have been obtained with high tensile strength at high temperatures noticeably by using silicon carbide fibers without deteriorating the corrosion resistance and the oxidation resistance of chromium, and are very valuable as the heat resistant materials.

DETAILED EXPLANATION OF THE INVENTION

Figure 1:
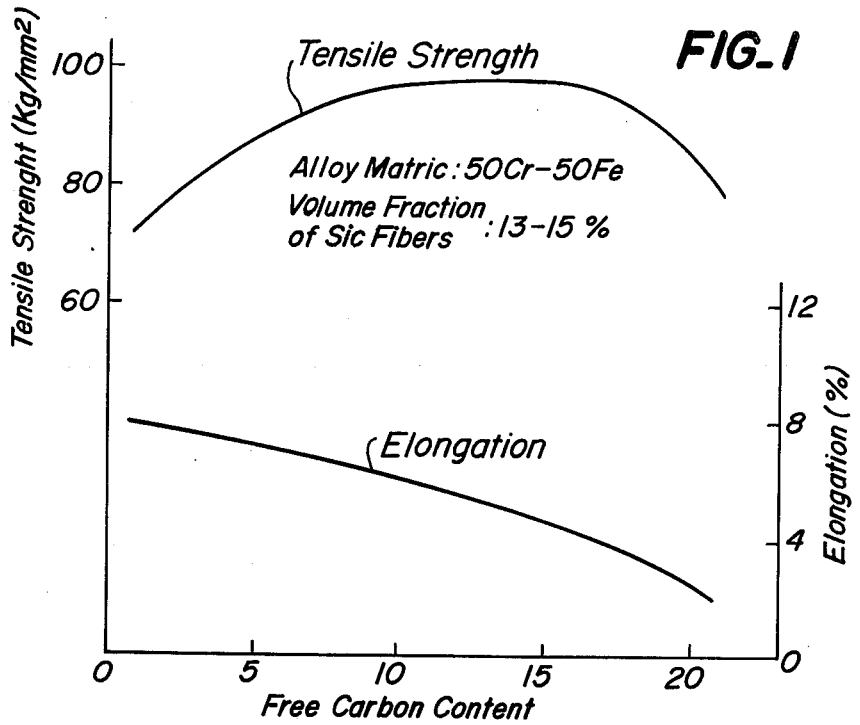
FIG. 1 is a graphical representation showing a relation between an amount of free carbon contained in the silicon carbide fibers and the elongation and tensile strength of the composite materials reinforced with the silicon carbide fibers according to the present invention.

The present invention is to provide chromium base alloy composite materials in which the tensile strength at high temperatures is improved without deteriorating the corrosion resistance at high temperatures by incorporating silicon carbide fibers as a reinforcing material into chromium base alloy and a method for producing the same.

A small amount of SiC in the silicon carbide fibers is decomposed into silicon and carbon in chromium base alloys at high temperatures and the element of the above described alloy reacts with free silicon to form a silicate and with free carbon to form a carbide. However, according to the present invention free carbon contained in the silicon carbide fibers preferentially and easily reacts with chromium base alloy to form a carbide, so that the reaction of chromium with carbon, which is formed by decomposition of silicon carbide, is restrained and that the silicon carbide fibers remain mostly in unchanged state. Furthermore, when the carbide composed of the above described free carbon and chromium is formed at the boundary between the silicon carbide fibers and chromium base alloy matrix, the bonding ability between both the silicon carbide fibers and chromium base alloy matrix are improved. So that it has been found that the shear strength becomes higher and it has been noticed that the stable composite material can be obtained and the present invention has been accomplished.

The silicon carbide fibers to be used in the present invention must contain 0.01–20% by weight of free carbon and these fibers are produced by the method as disclosed in U.S. Pat. application No. 677,960.

The first aspect of the present invention consists in chromium base alloy composite materials reinforced with silicon carbide fibers obtained by incorporating silicon carbide fibers containing 0.01–20% by weight of free carbon into chromium base alloy consisting of 20–98% by weight of chromium and of the remainder iron in volume fraction of 5–20%.

The second aspect of the present invention consists in chromium base alloy composite materials reinforced with silicon carbide fibers obtained by incorporating a volume fraction of 2–50% of silicon carbide fibers containing 0.01–20% by weight of free carbon into chromium base alloy consisting of 20–98% by weight of Cr, if necessary containing at least one of Ni and Co; at least one of Ru and Re; C; at least one of Nb, Ta, Ti, V, Zr, Hf and V; W; Mo; Si; Be; B; Al; at least one of Ca, Mg and Y; at least one of rare earth metals, and of the remainder Fe. In the above elements it is limited that Ni and Co being 30–60% by weight, Ru and Re being 15–40% by weight, C being not more than 0.7% by weight, Nb, Ta, Ti, V, Zr, Hf and V being 0.01–5.0% by weight, W being not more than 20% by weight, Mo being not more than 30% by weight, Si being not more than 5% by weight, Mn being not more than 10% by weight, Be being not more than 1% by weight, B being not more than 0.1% by weight, Al being not more than 10% by weight, Ca, Mg and Y being not more than 0.5% by weight and rare earth metals being not more than 1.0% by weight.

The chromium base alloy composite materials of the above described first aspect of the present invention are produced by laminating and arranging a volume fraction of 2–50% of the above described specific silicon carbide fibers containing 0.01–20% by weight of free carbon in chromium base alloy powders consisting of 20–98% by weight of Cr and the remainder Fe and then compressing and sintering the resulting assembly to react the free carbon in the silicon carbide fibers with chromium base alloy powders to form carbides, whereby the binding ability of the silicon carbide fibers and chromium base alloy becomes higher. The chromium base alloy composite materials of the above described second aspect of the present invention are produced by laminating and arranging a volume fraction of 2–50% of the above described specific silicon carbide fibers containing 0.01–20% by weight of free carbon into chromium base alloy powders consisting of 20–98% by weight of Cr, if necessary containing at least one of Ni and Co; at least one of Ru and Re; C; at least one of Nb, Ta, Ti, V, Zr, Hf and V; W; Mo; Si; Mn; Be; B; Al; at least one of Ca, Mg and Y; at least one of rare earth metals, and the remainder Fe. In the above elements it is limited that Ni and Co being 30–60% by weight, Ru and Re being 15–40% by weight, C being not more than 0.7% by weight, Nb, Ta, Ti, V, Zr, Hf and V being 0.01–5.0% by weight, W being not more than 20% by weight, Mo being not more than 30% by weight, Si being not more than 5% by weight, Mn being not more than 10% by weight, Be being not more than 1% by weight, B being not more than 0.1% by weight, Al being not more than 10% by weight, Ca, Mg and Y being not more than 0.5% by weight and rare earth metals being not more than 1.0% by weight, or into mixture powders obtained by mixing metal powders constituting the above described chromium base alloy in the above described constituting ratio, and then compressing and sintering the resulting assembly to react the free carbon in the silicon carbide fibers with chromium base alloy powders or the above described mixture powders to form carbides, whereby the binding ability of the silicon carbide fibers and chromium base alloy becomes higher.

Such silicon carbide fibers can be produced from the organosilicon compound classified by the following groups (1) - (10).

(1) Compounds having only Si—C bond.
(2) Compounds having Si—H bond in addition to Si—C bond.
(3) Compounds having Si—Hal bond.
(4) Compounds having Si—N bond.
(5) Compounds having Si—OR bond.
(R: alkyl or aryl group)
(6) Compounds having Si—OH bond.
(7) Compounds having Si—Si bond.
(8) Compounds having Si—O—Si bond.
(9) Esters of organosilicon compound, and
(10) Peroxides of organosilicon compounds.

At least one of the organosilicon compounds belonging to the above described groups (1) - (10) is subjected to polycondensation reaction by using at least one process of irradiation, heating and addition of polycondensing catalyst to form organosilicon high molecular weight compounds having silicon and carbon as the main skeleton components. For example, the compounds having the following molecular structures are produced.

(a)

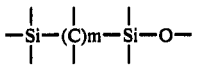

-continued (b)

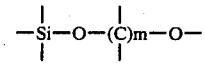

(c)

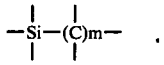

(d) The compounds having the above described skeleton components (a) - (c) as at least one partial structure in linear, ring and three dimensional structures or mixtures of the compounds having the above described skeleton components (a) - (c).

The compounds having the above described molecular structures are, for example, as follows.

(a)

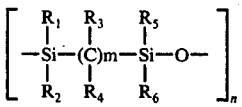

$m$ = 1, polysilmethylenesiloxane,
$m$ = 2, polysilethylenesiloxane,
$m$ = 6, polysilphenylenesiloxane,
$m$ = 12, polysildiphenylenesiloxane, (b)

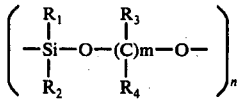

$m$ = 1, polymethyleneoxysiloxane,
$m$ = 2, polyethyleneoxysiloxane,
$m$ = 6, polyphenyleneoxysiloxane,
$m$ = 12, polydiphenyleneoxysiloxane, (c)

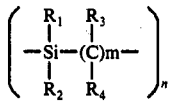

$m$ = 1, polysilmethylene,
$m$ = 2, polysilethylene,
$m$ = 3, polysiltrimethylene,
$m$ = 6, polysilphenylene,
$m$ = 12, polysildiphenylene, and (d) the compounds having the above described skeleton components as at least one partial structure in linear, ring and three dimensional structures or mixtures of the compounds having the above described skeleton components (a) - (c), wherein $R_1$-$R_6$ show hydrogen, methyl or methylene group, ethyl or ethylene group, phenyl or phenylene group or a halogen atom, and integers $n$ and $m$ are in the range $2 \leqq n \leqq 500$ and $1 \leqq m \leqq 12$.

The above described organosilicon high molecular weight compounds are spun continuously and if necessary, the spun fibers are heated under an oxidizing atmosphere to form oxidized layer on the fiber surface and then preliminarily heated under at least one atmosphere of vacuum, an inert gas, CO gas, hydrogen gas and hydrocarbon gas and then baked at a high temperature of 1,000°-2,000° C under at least one atmosphere of vacuum, inert gas, CO gas and hydrogen gas to form continuous silicon carbide fibers having a very high strength and a high Young modulus.

The reason why the above described baking temperature is defined to be 1,000°-2,000° C is as follows. At a temperature lower than 1,000° C, conversion of organic compounds into inorganic silicon carbide in the fiber is not fully attained and the strength and Young modulus of the fibers are small, while at a temperature higher than 2,000° C, the decomposition reaction of silicon carbide becomes violent.

The ratio of silicon and carbon contained in the organosilicon high molecular weight compounds (a) - (d), which are the starting material of the above described silicon carbide continuous fibers is at least 5 atoms of carbon to 2 atoms of silicon, so that when the organosilicon high molecular weight compounds are spun and then baked, a major part of carbons bonding to the side chain of the high molecular weight compounds are converted into hydrocarbons, which are volatilized but 0.01%-20% by weight of free carbon can be remained in the silicon carbide fibers.

As mentioned above, the present invention uses the continuous silicon carbide fibers containing not less than 0.01% by weight of free carbon but it has been found that the amount of the free carbon must be in a range up to 20% by weight. That is, the relation of the amount of the free carbon to the tensile strength and the elongation of the composite materials obtained by using the silicon carbide fibers containing different amounts of the free carbon and incorporating 13 - 15% of volume fraction of the silicon carbide fibers into 50Cr — 50Fe alloy is shown in FIG. 1. As seen from FIG. 1, the tensile strength is improved until the amount of the free carbon is about 12% but when the amount exceeds 12%, the variation is not observed and when the amount exceeds about 17%, the tensile strength lowers. Furthermore, the value of the elongation decreases, as the amount of the free carbon increases. Accordingly, it is advantageous to use the silicon carbide fibers containing up to 20% of the free carbon. The reaction of the free carbon in the silicon carbide fibers with chromium base alloy is more preferential than the reaction of carbon formed by the decomposition of silicon carbide fiber with chromium base alloy, so that a part of the free carbon becomes carbide, which precipitates on the silicon carbide fiber surface and as the result the bonding ability between the silicon carbide fibers and chromium base alloy larger, whereby the tensile strength is increased. When the free carbon is less than 0.01%, the bonding ability of the silicon carbide fibers and chromium base alloy is poor, while when the amount of the free carbon exceeds 20%, the amount of the formed carbide becomes larger and therefore the value of elongation is considerably decreased, so that the amount of the free carbon must be 0.01 - 20%.

Figure 2:
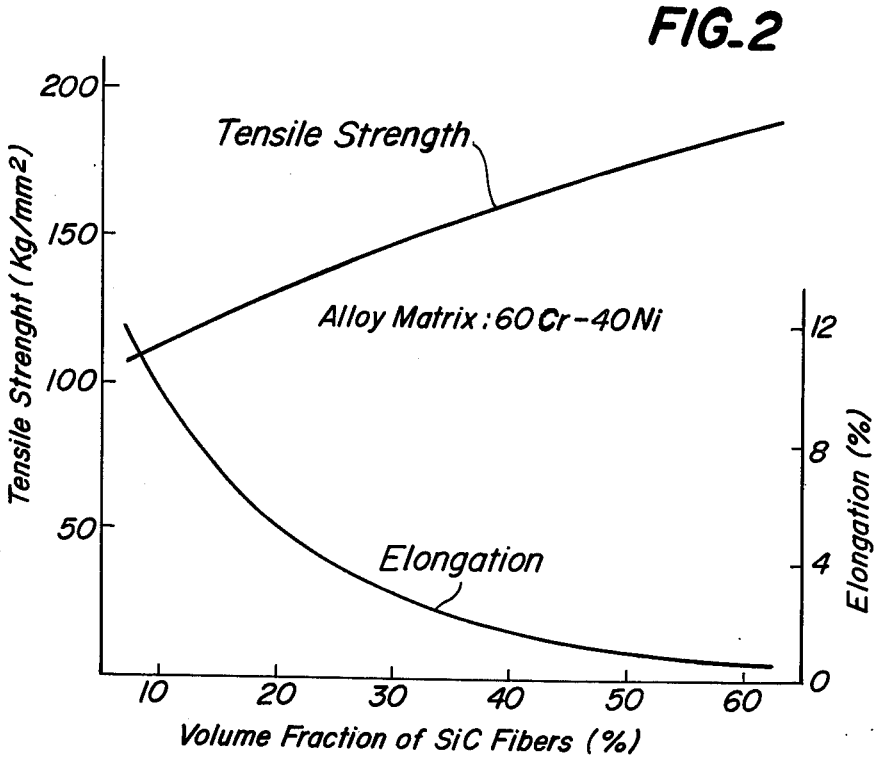
FIG. 2 is a graphical representation showing a relation between the volume fraction of the silicon carbide fibers in the composite materials according to the present invention and the tensile strength at room temperature.

Furthermore, it has been found that even when the silicon carbide fibers containing free carbon in a range of the particularly defined amount are selected, the tensile strength of the composite material varies depending upon the volume fraction of the silicon carbide fibers. That is, as seen from FIG. 2, when the silicon carbide fibers containing about 7% of free carbon is incorporated up to about 60% in volume, the tensile strength increases substantially monotonically but the elongation tends to lower. Even when the volume fraction exceeds 50%, the tensile strength increases but the elongation noticeably lowers, so that the volume fraction must be not more than 50%. When the volume fraction is less than 2%, the improvement of the tensile strength due to the incorporation of the silicon carbide fibers is few, so that the volume fraction must be 2 - 50%.

Figure 3:
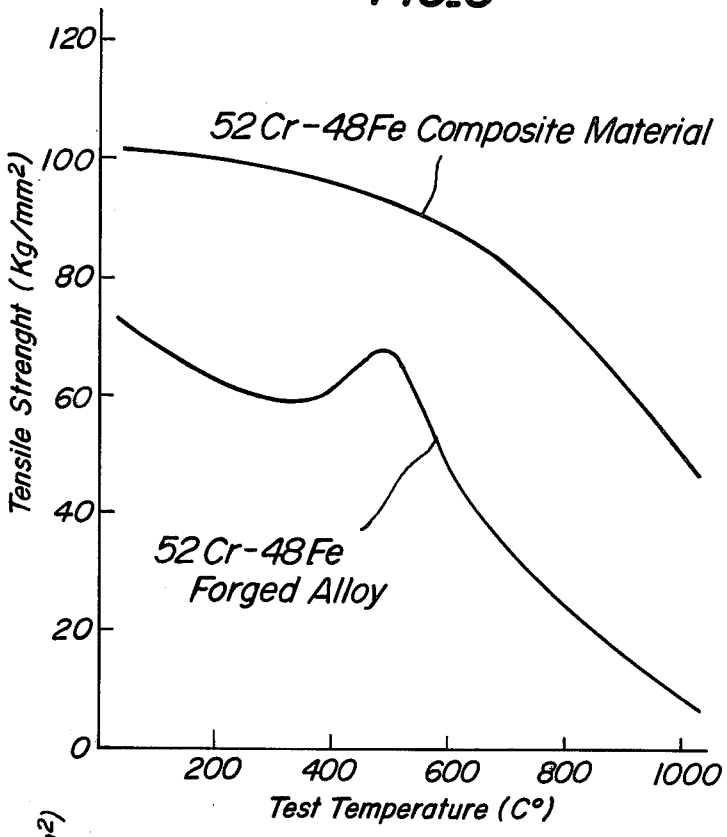
FIG. 3 is a graphical representation showing an embodiment of the tensile strength at high temperatures of the composite material according to the present invention.

The tensile strength at high temperatures of the composite materials according to the present invention is shown in FIG. 3 and as seen from FIG. 3, said tensile strength is extremely superior to that of the comparative material of 52Cr — 48Fe alloys and even at 900° C the tensile strength of about 50 kg/mm$^2$ is maintained.

An explanation will be made with respect to the reasion of the limitation of the components of the alloy in the composite materials.

Chromium is necessary at least 20% by weight in order to obtain the oxidation resistance and corrosion resistance at high temperatures. On the other hand, the upper limit of chromium must be not more than 98%, because the alloy having a high chromium component near pure chromium has the ductility-brittleness transition temperature of higher than room temperature and is poor in the practicability.

When each of ruthenium and rhenium is added to chromium base alloy in an amount of not less than 15% by weight, the ductility-brittleness transition temperature considerably lowers and the ductility at room temperature is increased. On the other hand, even if more than 40% by weight is added, the improving effect is few, so that the amount must be 15 - 40%. Even if ruthenium and rhenium are added in combination, the effect does not vary, so that both the elements may be used in combination in an amount of 15 - 40%.

Cobalt and nickel are the elements effective for improving the tensile strength at high temperatures of chromium base alloy but the addition of a large amount is economically disadvantageous and the amount must be 30 - 60%.

Carbon forms carbides of niobium, tantalum, titanium, vanadium, tungsten and the like to increase the tensile strength at high temperatures. However, the addition of more than 0.7% by weight considerably deteriorates the toughness, so that the amount of carbon should be limited to not more than 0.7% by weight.

Niobium, tantalum, titanium, vanadium, zirconium, hafnium and uranium react with carbon and nitrogen in chromium base alloy to form stable carbides or nitrides to improve the creep rupture strength at high temperatures, but when the silicon carbide fibers containing the free carbon are incorporated into the chromium based alloy containing the above described elements, the free carbon in the silicon carbide fibers and the above described elements in the chromium base alloy form more stable carbides than chromium carbide at the boundary between the silicon carbide fibers and chromium base alloy matrix to improve the bonding ability and to increase the shear resistance of the boundary at high temperatures and to increase the tensile strength at high temperatures. Furthermore, the above described elements are added in the content of less than 0.01% by weight, the improving effect is unexpectable, and even if more than 5% by weight is added, the more improvement cannot be expected, so that the range must be 0.01 - 5% by weight.

Any of tungsten, molybdenum, silicon, manganese, beryllium and boron are the elements effective for improving the tensile strength at high temperatures of chromium base alloy, but the addition of a large amount considerably deteriorates the ductility of said alloy matrix at room temperature, so that tungsten should be not more than 20% by weight, molybdenum should be not more than 30% by weight, silicon should be not more than 50% by weight, manganese should be not more than 10% by weight, beryllium should be not more than 1% by weight and boron should be not more than 0.1% by weight.

Any of aluminum, calcium, magnesium, yttrium and rare earth metals are the elements effective for promoting the formation of compact and strong $Cr_2O_3$ for the improvement of the oxidation resistance and the corrosion resistance of chromium base alloy, but the addition of a large amount deteriorates the purity of said alloy and lowers the ductility and the toughness, so that aluminum should be not more than 10% by weight, calcium should be not more than 0.5% by weight, magnesium should be not more than 0.5% by weight, yttrium should be not more than 0.5% by weight and rare earth metals should be not more than 1.0% by weight.

The following examples are given for the purpose of illustration of this invention and are not intended as limitations thereof. In the examples, "%" and "parts" mean by weight unless otherwise indicated.

EXAMPLE 1

An example for producing the continuous silicon carbide fibers to be used in the present invention will be explained hereinafter.

Dimethyldichlorosilane and sodium were reacted to produce polydimethylsilane. 250 g of polydimethylsilane was charged in an autoclave having a capacity of 1 l and air in the autoclave was substituted with argon gas and then the reaction was effected at 470° C for 14 hours. After completion of the reaction, the formed polycarbosilane was discharged as n-hexane solution. This n-hexane solution was filtrated to remove impruities and then n-hexane was evaporated under a reduced pressure, after which the residue was heated in an oil bath at 280° C under vacuum for 2 hours to effect concentration. Polycarbosilane was obtained in an yield of 40% based on dimethyldichlorosilane. A number average molecular weight of the formed polycarbosilane was 1,700. By using a usual spinning apparatus, the polycarbosilane was heated and melted at 330° C under argon atmosphere to form a spinning melt and the spinning melt was spun at a spinning rate of 200 m/min to obtain polycarbosilane fibers. The fibers were heated by raising the temperature from 20° C to 190° C in air in 6 hours and this temperature was kept for 1 hour to effect an unfusing treatment. The thus treated fibers were heated to 1,300° C at a temperature raising rate of 100° C/hr under vacuum of $1\times10^{-3}$ mmHg and this temperature was kept for 1 hour to form SiC fibers. The formed SiC fibers had, for example, an average diameter of 10 μm, an average tensile strength of 350 kg/mm$^2$, an average Young's modulus of $23\times10^3$ kg/mm$^2$ and a specific gravity of 2.70 g/cm$^3$.

A Cr-Ni alloy consisting of 49.5% of Cr, 50.0% of Ni, 0.05% of Nb and 0.05% of Fe was melted in a chamber kept under argon atmosphere. Silicon carbide fibers having an average diameter of 20 μm and containing 8% of free carbon were arranged in parallel in an alumina pipe of 10 mm diameter, both ends of which were open. One end of the tube was sealed and the other end was connected to a vacuum system. The interior of the tube was evacuated under heating, and then the tube was introduced into the above described argon gas chamber. The above described sealing of the alumina tube was removed in the argon gas chamber, and this open end of the tube was immersed into the above described melted alloy bath to infiltrate the melted alloy between the fibers in the alumina tube. The melted state of the alloy was maintained for 3 minutes to obtain a Cr — Ni alloy composite material reinforced with the silicon carbide fibers. The resulting composite material contained the silicon carbide fibers in a volume fraction of about 20%.

For comparison, a Cr — Ni alloy having the same composition as that of the above described Cr — Ni alloy and not containing silicon carbide fibers was produced, and the tensile strengths at room temperature of the Cr — Ni alloy and the Cr — Ni alloy composite material reinforced with the silicon carbide fibers were measured. It was found from the results that the Cr — Ni alloy composite material had a tensile strength of 115 kg/mm$^2$, which was about 1.4 times as high as the tensile strength of the comparative Cr — Ni alloy.

EXAMPLE 2

A powder mixture consisting of 100 parts of a Cr — Co alloy powder, which consists of 51.2% of Cr, 47.6% of Co, 0.2% of Hf and 1.0% of Fe, and 0.8 part of lithium stearate as a lubricant was charged in a mold having a width of 10 mm and a length of 100 mm. At the same time, silicon carbide fibers having an average diameter of 20 μm and containing 10% of free carbon were piled in parallel and embedded in the powder mixture, the volume fraction of the fibers being 25%. The resulting body was press molded under a pressure of about 10 t/cm$^2$, and the molded article was preliminary heated at 450° C for 2 hours under hydrogen atmosphere, kept at 1,150° C for 2 hours under argon gas atmosphere, and then pressed at this temperature under a pressure of 0.1 t/cm$^2$ under argon gas atmosphere to obtain a Cr — Co alloy composite material reinforced with the silicon carbide fibers.

For comparison, a sintered body containing no silicon carbide fibers was produced under the same condition as described above, and the tensile strengths of both sintered bodies were measured. The Cr — Co alloy composite material reinforced with the silicon carbide fibers according to the present invention had a tensile strength of 137 kg/mm$^2$, which was about 1.6 times as high as the tensile strength, 86 kg/mm$^2$, of the comparative alloy.

EXAMPLE 3

A powder mixture consisting of 100 parts of a Cr — Fe alloy powder, which consists of 52.0% of Cr, 47.5% of Fe, 0.48% of Mn and 0.02% of Ca, and 0.8 part of lithium stearate as a lubricant was charged in a mold having a width of 5 mm and a length of 80 mm. At the same time, silicon carbide fibers containing 0.8% of free carbon were piled in parallel and embedded in the powder mixture, the volume fraction of the fibers being 28%. The resulting body was press molded under a pressure of 10 t/cm$^2$. Then, under hydrogen gas atmosphere, the molded article was preliminarily heated at 450° C, kept at 1,150° C for 2 hours, and pressed at this temperature under a pressure of 0.05 t/cm$^2$ to obtain a Cr — Fe alloy composite material reinforced with the silicon carbide fibers according to the present invention.

Figure 4:
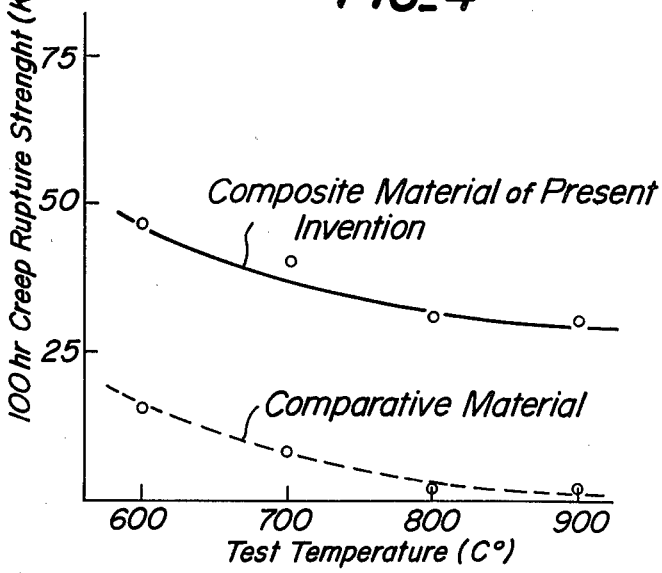
FIG. 4 is a graphical representation showing a relation between the creep rupture strength of the composite material in Example 3 and the test temperature.

For comparison, a forged Cr — Fe alloy having the same composition as that of the above described Cr — Fe alloy powder was produced, and creep tests of the Cr — Fe alloy composite material and the forged Cr — Fe alloy were carried out. The obtained results are shown in FIG. 4. It can be seen from FIG. 4 that the composite material reinforced with silicon carbide fibers is higher in the creep rupture strength and heat resistance than the comparative material.

EXAMPLE 4

A Cr — Mo alloy powder consisting of 7.5% of Mo, 1.9% of Ta, 0.07% of C, 0.11% of Y, 89.2% of Cr and 1.22% of Fe was melted and applied to silicon carbide fibers containing 4% of free carbon, which had previously been arranged in parallel, by a plasma spray method to produce composite sheets. The composite sheets were laminated in a mold having a width of 20 mm and a length of 100 mm, kept at 1,350° C under vacuum, and hot pressed under a pressure of 0.05 t/cm$^2$ to obtain a Cr — Mo alloy composite material reinforced with the silicon carbide fibers according to the present invention.

Figure 5:
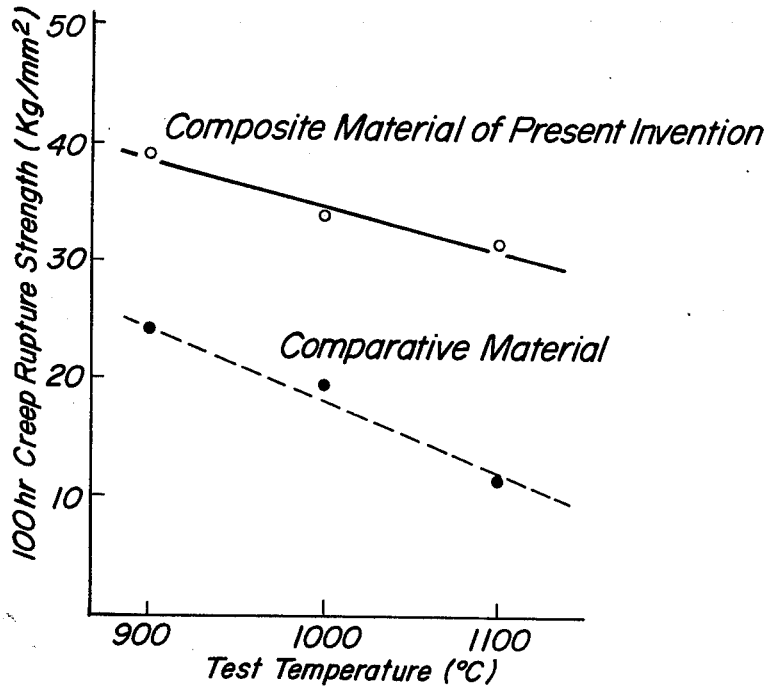
FIG. 5 is a graphical representation showing a relation between the creep rupture strength of the composite material in Example 4 and the test temperature.

For a comparison, a forged Cr — Mo alloy having the same composition as that of the above described Cr — Mo alloy powder was produced, and creep tests of the above obtained Mo — Cr composite material and the forged Mo — Cr alloy were carried out. The obtained results are shown in FIG. 5. It can be seen from FIG. 5, that the composite material reinforced with silicon carbide fibers is higher in the creep rupture strength and heat resistance than the comparative material.

As seen from the above described examples, the chromium base alloy composite materials reinforced with silicon carbide fibers are high in the tensile strength and are very high in the heat resistance, corrosion resistance and wear resistance. Therefore, the composite materials can be used widely as high-strength heat resistant materials, such as vanes and blades for gas turbine, nozzles, jigs for heat treatment, heat resistant springs and so on, and further can be advantageously used as materials for apparatus for producing synthetic fibers, materials for apparatus for synthetic chemistry, mechanical industrial materials, materials for domestic and office supplies, materials for constructing machine, fire protecting materials, ship and aircraft materials, electrical materials, agricultural machines, fishing implements, atomic impelements, nuclear fusion furnace material, sun heat utilizing material, medical instruments and so on. Accordingly, the composite materials are very useful for industrial purpose.

What is claimed is:

1. Chromium base alloy composite materials reinforced with silicon carbide fibers obtained by incorporating silicon carbide fibers containing 0.01 - 20% by weight of free carbon into chromium base alloy consisting of 20 - 98% by weight of chromium and the remainder iron in a volume fraction of 5 - 20%.

2. Chromium base alloy composite materials reinforced with silicon carbide fibers obtained by incorporating a volume fraction of 2 - 50% of silicon carbide fibers containing 0.01 - 20% by weight of free carbon into chromium base alloy consisting of 20 - 98% by weight of Cr, if necessary containing at least one of Ni and Co; at least one of Ru and Re; C; at least one of Nb, Ta, Ti, V, Zr, Hf and U; W; Mo; Si; Mn; Be; B; Al; at least one of Ca, Mg and Y; at least one of rare earth metals, and the remainder being Fe, provided that Ni and Co being 30 - 60% by weight, Ru and Re being 15 - 40% by weight, C being not more than 0.7% by weight, Nb, Ta, Ti, V, Zr, Hf and V being 0.01 - 5.0% by weight, W being not more than 20% by weight, Mo being not more than 30% by weight, Si being not more than 5% by weight, Mn being not more than 10% by weight, Be being not more than 1% by weight, B being not more than 0.1% by weight, Al being not more than 10% by weight, Ca, Mg and Y being not more than 0.5% by weight and rare earth metals being not more than 1.0% by weight.

3. A method for producing chromium base alloy composite materials reinforced with silicon carbide fibers, which comprises laminating and arranging a volume fraction of 2 - 50% of silicon carbide fibers containing 0.01 - 20% by weight of free carbon which have been produced by heating the spun fibers composed of organosilicon high molecular weight compounds having silicon and carbon as the main skeleton components at a temperature of 1,000°- 2,000° C, in chromium base alloy powders consisting of 20 - 98% by weight of Cr and the remainder Fe and then compressing and sintering the resulting assembly to react the free carbon in the silicon carbide fibers with chromium base alloy powders to form carbides, whereby the binding ability of the silicon carbide fibers and chromium base alloy is increased.

4. A method for producing chromium base alloy composite materials reinforced with silicon carbide fibers, which comprises laminating and arranging a volume fraction of 2 - 50% of silicon carbide fibers containing 0.01 - 20% by weight of free carbon which have been produced by heating the spun fibers composed of organosilicon high molecular weight compounds having silicon and carbon as the main skeleton components at a temperature of 1,000°- 2,000° C, into chromium base alloy powders consisting of 20 - 98% by weight of Cr, if necessary containing at least one of Ni and Co; at least one of Ru and Re; C; at least one of Nb, Ta, T, V, Zr, Hf and V; W; Mo; Si; Mn; Be; B; Al; at least one of Ca, Mg and Y; at least one of rare earth metals, and the remainder Fe, provided that Ni and Co being 30 - 60% by weight, Ru and Re being 15 - 40% by weight, C being not more than 0.7% by weight, Nb, Ta, Ti, V, Zr, Hf and V being 0.01 - 5.0% by weight, W being not more than 20% by weight, Mo being not more than 30% by weight, Si being not more than 5% by weight, Mn being not more than 10% by weight, Be being not more than 1% by weight, B being not more than 0.1% by weight, Al being not more than 10% by weight, Ca, Mg and Y being not more than 0.5% by weight and rare earth metals being not more than 1.0% by weight or into mixture powders obtained by mixing metal powders constituting the above described chromium base alloy in the above described contituting ratio, and then compressing and sintering the resulting assembly to react the free carbon in the silicon carbide fibers with chromium base alloy powders or the above described mixture powders to form carbides, whereby the binding ability of the silicon carbide fibers and chromium base alloy is increased.

* * * * *